US008225512B2

(12) United States Patent
Coleman et al.

(10) Patent No.: US 8,225,512 B2
(45) Date of Patent: Jul. 24, 2012

(54) VACUUM DEVICE FOR HAIR CLIPPINGS

(75) Inventors: Brian Michael Coleman, Desoto, TX (US); Daniel Joseph Laundrie, Lena, WI (US)

(73) Assignee: Surgical Site Solutions, Inc., Sheboygan, WI (US)

( * ) Notice: Subject to any disclaimer, the term of this patent is extended or adjusted under 35 U.S.C. 154(b) by 555 days.

(21) Appl. No.: 12/395,703

(22) Filed: Mar. 1, 2009

(65) Prior Publication Data

US 2009/0223058 A1 Sep. 10, 2009

Related U.S. Application Data

(60) Provisional application No. 61/033,791, filed on Mar. 5, 2008.

(51) Int. Cl.
*B25F 3/00* (2006.01)

(52) U.S. Cl. ..... 30/133; 30/41.6

(58) Field of Classification Search ..... 30/41.6, 30/133

See application file for complete search history.

(56) References Cited

U.S. PATENT DOCUMENTS 1,618,713 A * 2/1927 Kaufmann ..... 30/133
2,129,559 A * 9/1938 Blackwell ..... 30/41.5
2,228,020 A * 1/1941 Testi ..... 30/43.1
2,697,876 A * 12/1954 Blanchard ..... 30/133
2,748,472 A 6/1956 Sheley et al.
2,946,122 A * 7/1960 Gaskins ..... 30/133
3,217,407 A * 11/1965 Azar ..... 30/133
3,230,619 A * 1/1966 Felland ..... 30/133
3,295,200 A * 1/1967 Padgett et al. ..... 30/133
3,302,286 A * 2/1967 Zucker ..... 30/133
3,331,130 A 7/1967 Ligon
3,348,308 A * 10/1967 Andis ..... 30/133
3,383,765 A * 5/1968 Meltzer ..... 30/123
3,384,919 A * 5/1968 Jording et al. ..... 15/339
3,440,661 A 4/1969 Hixon et al.
3,611,566 A 10/1971 Brennan, Sr.
3,699,652 A * 10/1972 Deverman et al. ..... 30/29.5
3,797,111 A 3/1974 Keane
4,077,122 A 3/1978 Rollor, Jr. et al.
4,216,481 A 8/1980 Hakoyama
4,667,405 A 5/1987 Trichell et al.
4,843,717 A 7/1989 Crane
4,974,321 A 12/1990 Yoshida
5,088,199 A * 2/1992 Romani ..... 30/133
5,142,786 A 9/1992 Hunts
5,153,994 A 10/1992 Emmett
D337,176 S 7/1993 Romani
D348,543 S 7/1994 Melton
5,881,462 A * 3/1999 Romani ..... 30/133
5,924,202 A * 7/1999 Romani ..... 30/133
5,960,515 A 10/1999 Lu
6,571,478 B1 * 6/2003 Romani et al. ..... 30/133
6,739,053 B2 5/2004 McCambridge et al.

(Continued)

*Primary Examiner* — Hwei C Payer
(74) *Attorney, Agent, or Firm* — Ryan Kromholz & Manion, S.C.

(57) ABSTRACT

A device for removing hair clippings is disclosed. The device comprises a suction member having an opening, a top side and a bottom side, a hose attachment member connected to the suction member, and a fastening member adapted for affixing onto a hair clipper, with the fastening member being attached to the bottom side of the suction member. This device is particularly useful for removing the hair clippings from shaved surgical patients in a manner that prevents the hair clippings from falling into the patient's surroundings and thus prevent contamination.

4 Claims, 17 Drawing Sheets

U.S. PATENT DOCUMENTS

| | | | | |
|---|---|---|---|---|
| 7,114,257 | B1 | 10/2006 | Ortega | |
| 7,159,274 | B2 | 1/2007 | Freidell | |
| 7,228,630 | B2 | 6/2007 | Obermann | |
| 7,488,004 | B1 | 2/2009 | Romani et al. | |
| 2002/0108255 | A1* | 8/2002 | Degregorio, Jr. | 30/133 |
| 2003/0101591 | A1 | 6/2003 | Romani et al. | |
| 2006/0230616 | A1 | 10/2006 | Williams | |
| 2008/0250649 | A1 | 10/2008 | Spigai | |
| 2011/0185578 | A1* | 8/2011 | Landrie et al. | 30/133 |

* cited by examiner

FIG. 1A
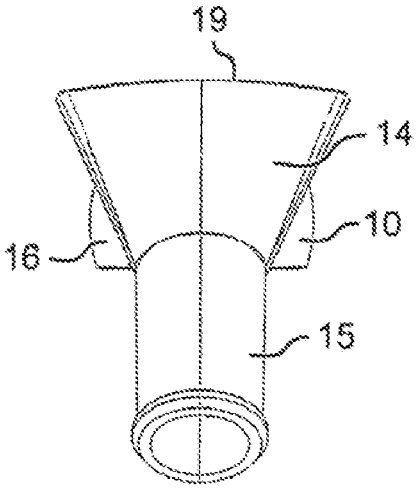
FIG. 1C
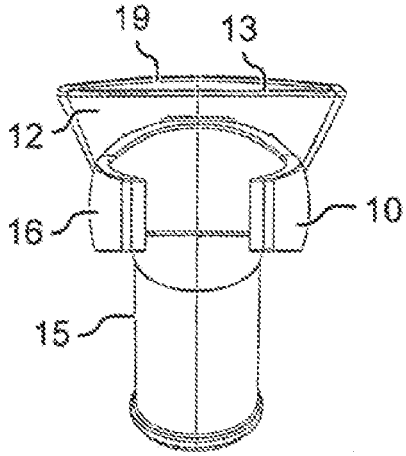
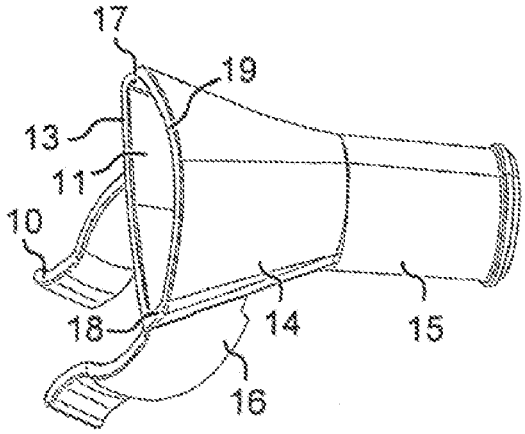
FIG. 1B
FIG. 1D
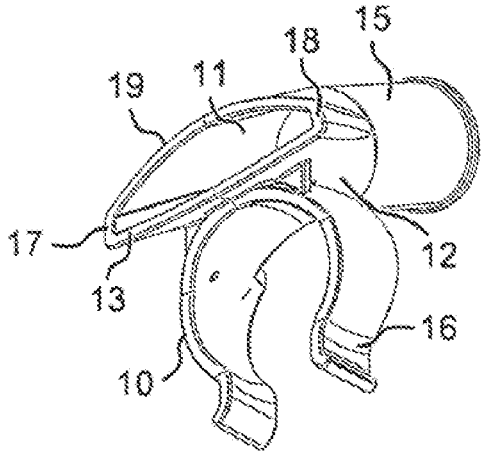

FIG. 1E
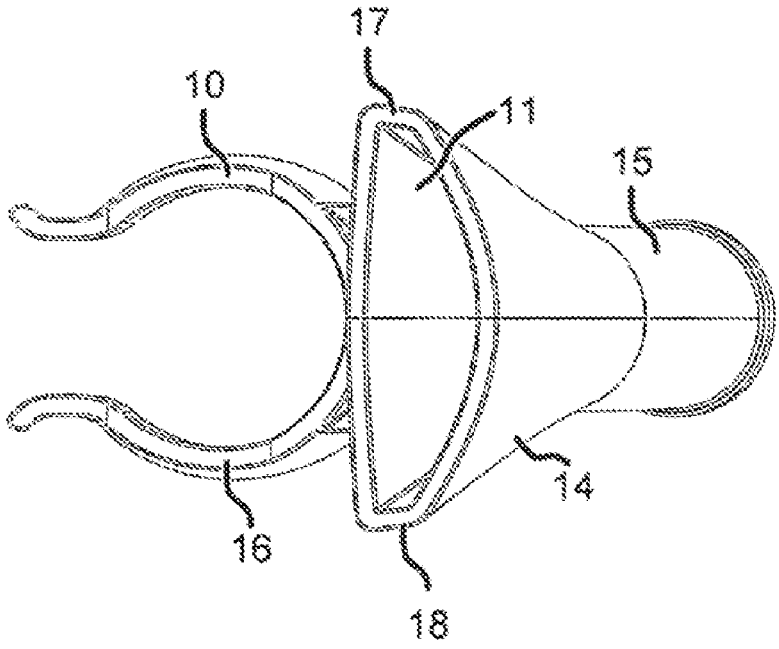
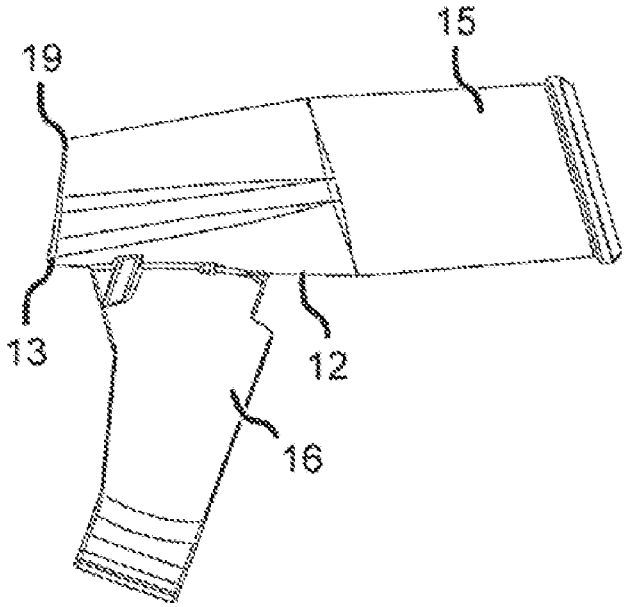
FIG. 1F

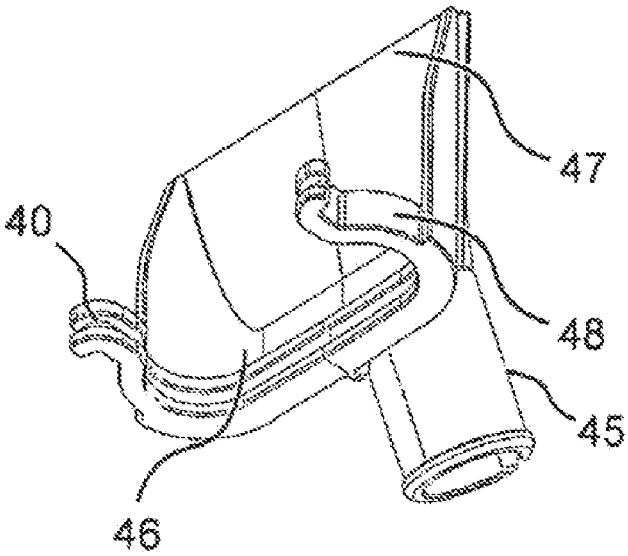
FIG. 3D
FIG. 3E
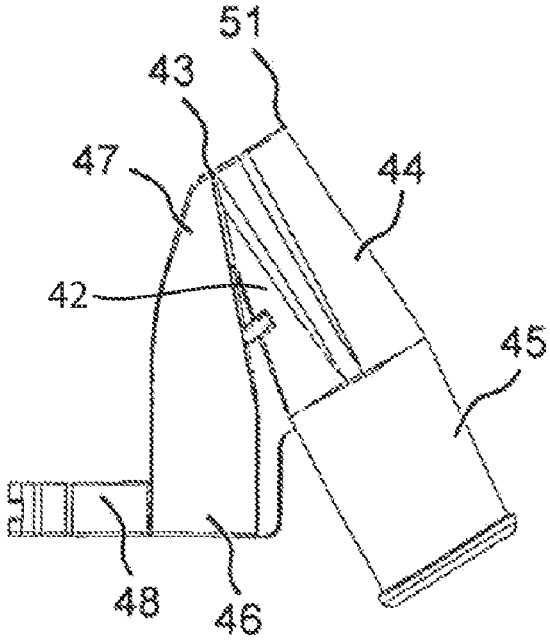

VACUUM DEVICE FOR HAIR CLIPPINGS

This application claims priority from provisional application No. 61/033,791 filed on Mar. 5, 2008.

FIELD OF THE INVENTION

The present invention relates to a hair clipper vacuum device for removing shaved or clipped hair. More specifically, the present invention is a disposable hair clipper vacuum device attached to a surgical hair clipper.

BACKGROUND OF THE INVENTION

Surgical patients are often shaved prior to invasive or surgical procedures around the areas of incision to remove hair that might harbor germs and thus serve as a source of contamination. The patients are commonly shaved in their hospital rooms, preoperative area or in the surgical suite. Loose hair clippings that remain on the patient, fall onto the sheets, covers and bed surroundings must be picked up and removed. At present, the most common protocol for picking up the loose hair clippings is to press an adhesive backed material, usually a tape, against the areas where the clipped hair remains. This method, however, is unsanitary, inefficient and misses many hair clippings, which is potentially harmful to the patient. Furthermore, adhesive tapes are not typically kept under sterile conditions which increase the risk of spreading infectious contaminants not only through the surgical suite but possibly throughout the medical facility.

Several prior art patents disclose vacuum devices attached to hair grooming clippers and shavers typically used in barber shops. Among these are U.S. Pat. Nos. 6,571,478, 5,924,202, 5,881,462, and 3,348,308. The vacuum attachments of the prior art do not however fit most surgical clipper designs and are furthermore not designed to be disposable.

SUMMARY OF THE PRESENT INVENTION

In one aspect of the present invention, a device comprises a suction member having an opening and a bottom side; a hose attachment connected to the suction member; and a fastening member adapted for affixing onto a hair clipper, the fastening member being attached to the bottom side of the suction member.

In another aspect of the present invention, a system for removing clipped hair from surgical patients comprises the device of the present invention; a hose having a first end and a second end, with the first end of the hose being connected to the hose attachment of the device; and a vacuum source comprising a hose attachment, with the hose attachment of the vacuum source being connected to the second end of the hose.

These and other features, aspects and advantages of the present invention will become better understood with reference to the following drawings, description and claims.

BRIEF DESCRIPTION OF THE DRAWINGS

FIG. 1A is a top elevation view of the device according to one embodiment of the present invention.

FIG. 1B is a top and side perspective view of the device according to the embodiment of FIG. 1A.

FIG. 1C is a bottom elevation view of the device according to the embodiment of FIG. 1A.

FIG. 1D is a front and side perspective view of the device according to the embodiment of FIG. 1A.

FIG. 1E is a front and top perspective view of the device according to the embodiment of FIG. 1A.

FIG. 1F is a side elevation view of the device according to the embodiment of FIG. 1A.

FIG. 3D is a bottom and back perspective view of the device according to the embodiment of FIG. 3A.

FIG. 3E is a side elevation view of the device according to the embodiment of FIG. 3A.

DETAILED DESCRIPTION OF THE INVENTION

Figure 2A:
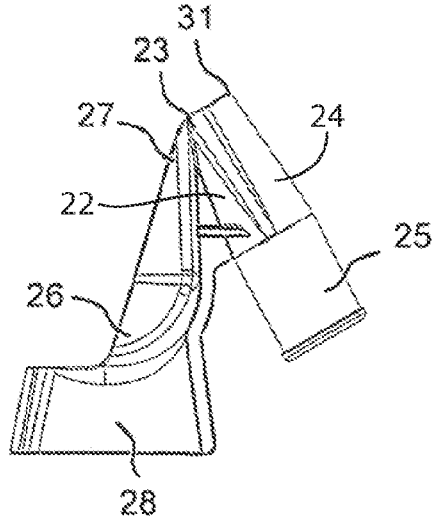
FIG. 2A is a side elevation view of the device according to one embodiment of the present invention.
Figure 2B:
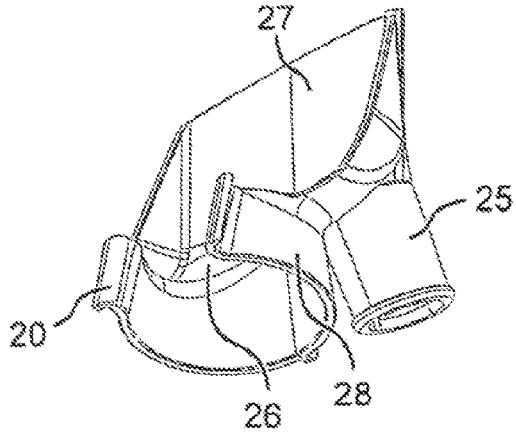
FIG. 2B is a bottom and back perspective view of the device according to the embodiment of FIG. 2A.
Figure 2C:
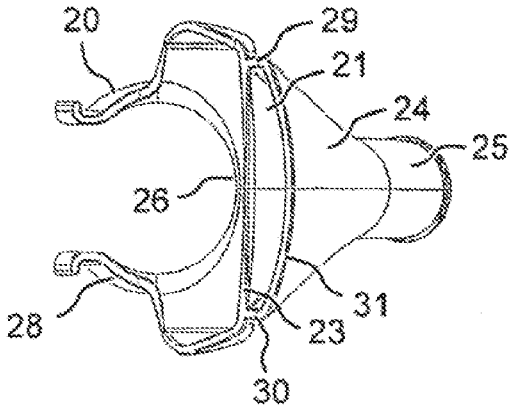
FIG. 2C is a front elevation view of the device according to the embodiment of FIG. 2A.
Figure 2D:
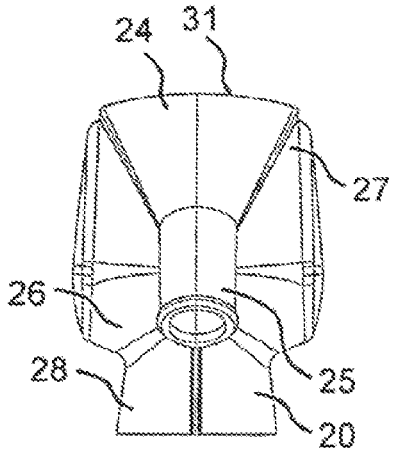
FIG. 2D is a top elevation view of the device according to the embodiment of FIG. 2A.
Figure 2E:
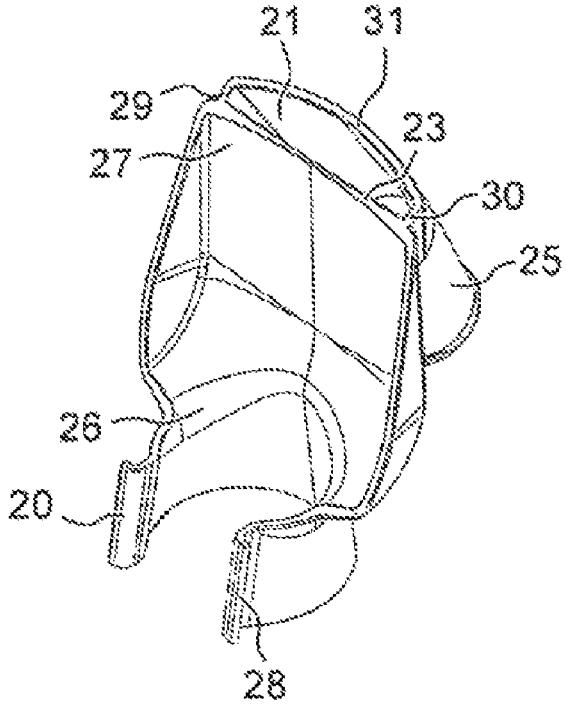
FIG. 2E is a bottom and front perspective view of the device according to the embodiment of FIG. 2A.
Figure 2F:
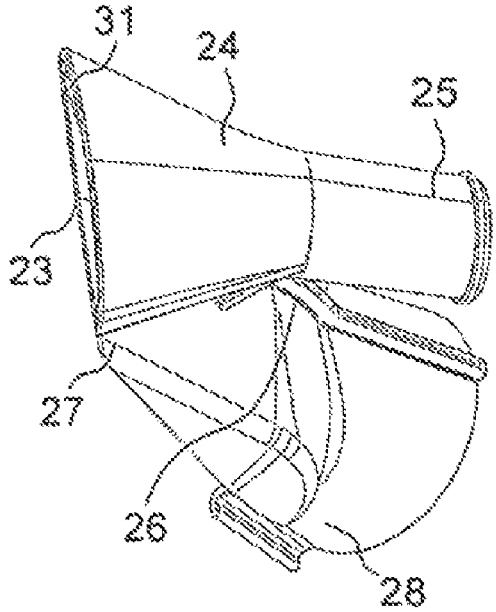
FIG. 2F is a top and side perspective view of the device according to the embodiment of FIG. 2A.
Figure 3A:
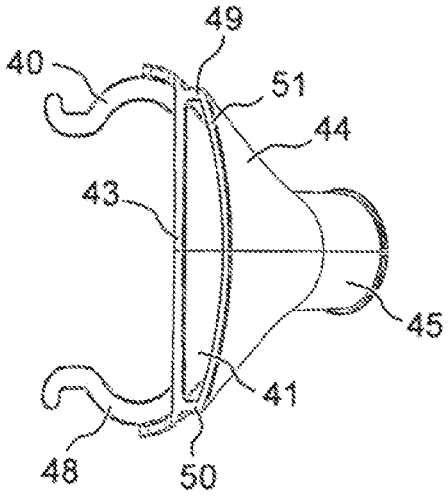
FIG. 3A is a front elevation view of the device according to one embodiment of the present invention.
Figure 3B:
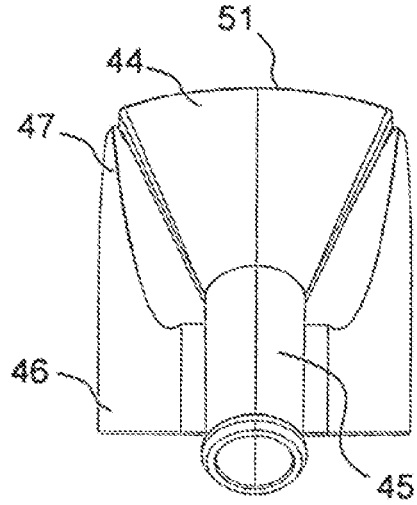
FIG. 3B is a top elevation view of the device according to the embodiment of FIG. 3A.
Figure 3C:
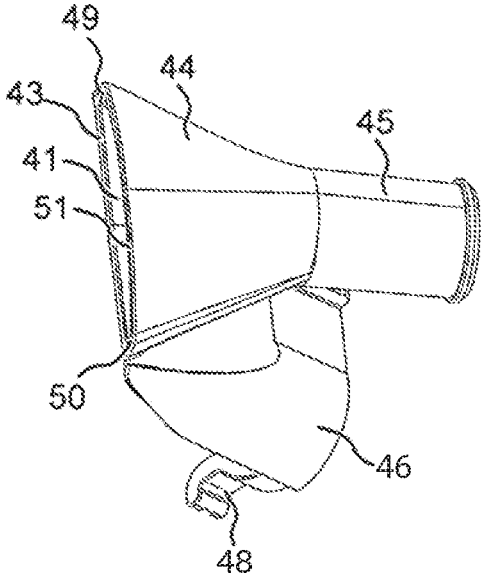
FIG. 3C is a top and side perspective view of the device according to the embodiment of FIG. 3A.
Figure 4A:
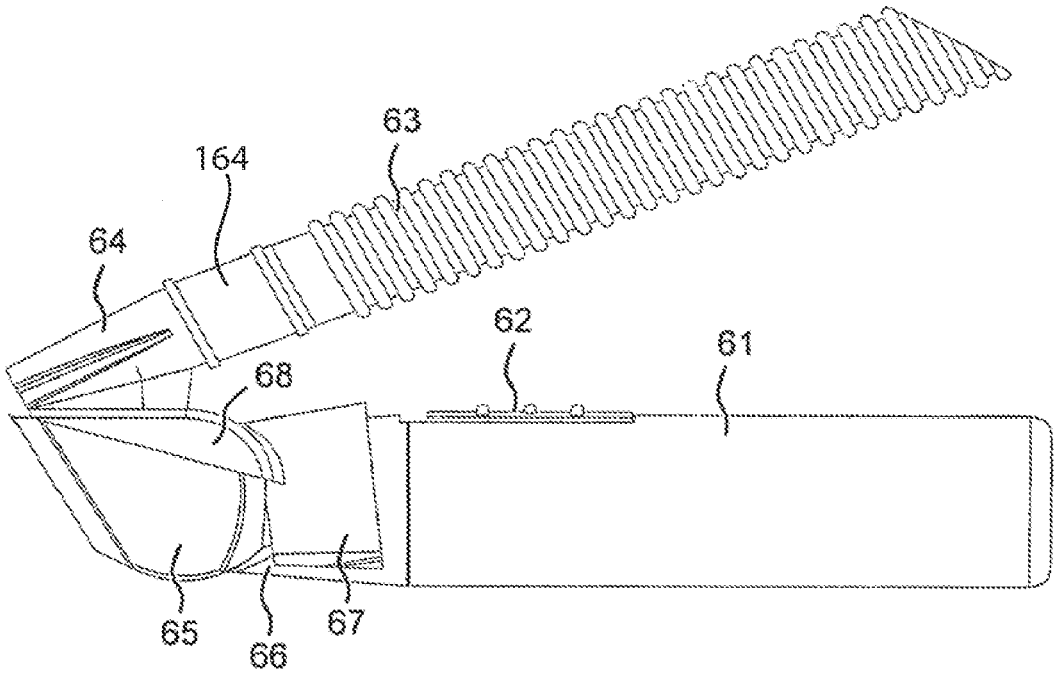
FIG. 4A is a side view of the system for removing hair containing the device according to the embodiment of FIG. 2A.
Figure 4B:
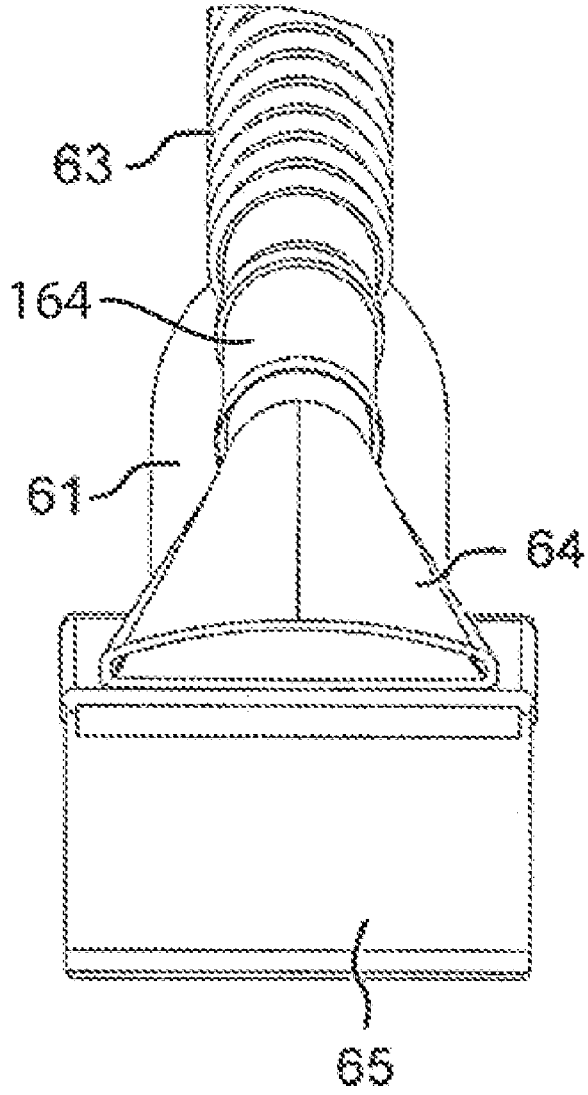
FIG. 4B is a top view of the system for removing hair containing the device according to the embodiment of FIG. 2A.
Figure 4C:
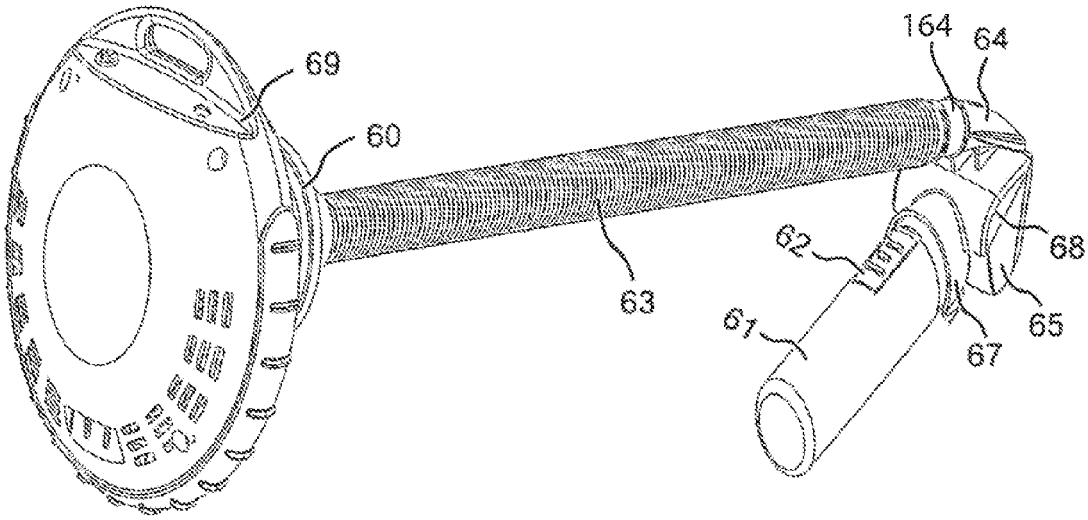
FIG. 4C is a top and side view of the system for removing hair containing the device according to the embodiment of FIG. 2A.
Figure 4D:
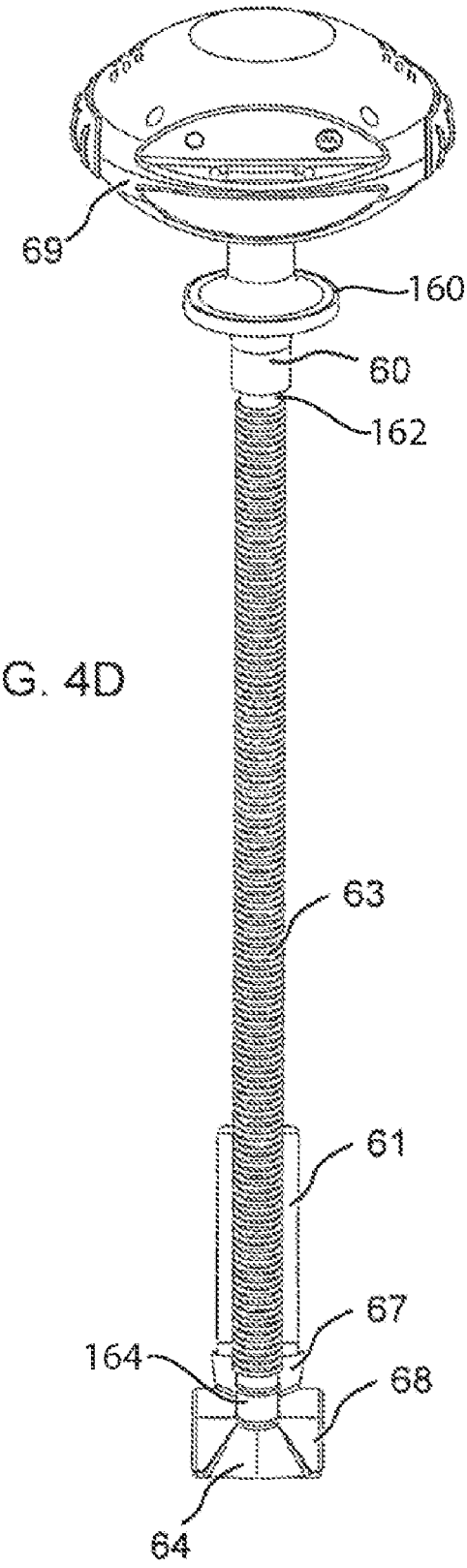
FIG. 4D is a top view of the system for removing hair containing the device according to the embodiment of FIG. 2A.
Figure 4E:
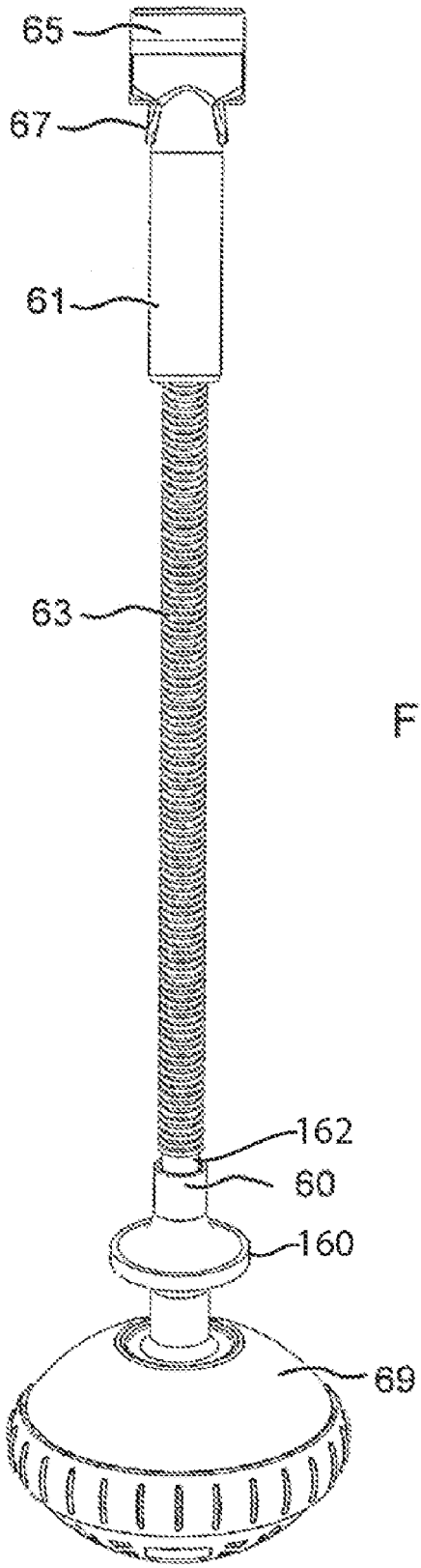
FIG. 4E is a bottom view of the system for removing hair containing the device according to the embodiment of FIG. 2A.

The present invention relates to a device attached to a hair clipper designed to remove hair clippings. The hair clipper may is particularly useful for removing the hair clippings of patients that undergo surgical procedures in an efficient and sanitary fashion. It may also be used in barber shops, animal grooming shops, and other applications in which hair is trimmed and needs to be cleaned. The embodiments of the device are designed to attach to all of the common surgical clippers currently on the market.

The device of the present invention comprises a suction member connected to a suction source such as a vacuum pump using a hose attachment and a hose. The hose may be flexible and extendable. The suction member may have an opening that is positioned in close proximity to the razor segment of the hair clipper. Hair removed by the razor is thus quickly drawn away by the suction action of the vacuum source. A fastening member may be attached to the bottom of the suction member and used for affixing the device onto the hair clipper. The design of the fastening member depends on the design of the hair clipper. There are at present time three manufacturers that market surgical hair clippers: MediClip®, the CardinalHealth®, and 3M™. The embodiments of the device of the present invention are designed to fit all the models of these manufacturers currently on the market. The 3M™ model has a razor segment attached to a swiveling ball which is in turn is attached to the hand held piece. The fastening member of the device adapted for attaching to the 3M™ surgical clipper may contain two flexible arms to attach to the 3M™ surgical clipper swiveling ball. The MediClip® and the CardinalHealth® designs may contain a razor segment attached to a neck portion which in turn is connected to a hand held piece. The fastening member of the device adapted for attaching to the MediClip® and the CardinalHealth® surgical clippers may contain a razor segment attaching member and a neck attaching member.

The opening of the suction member may be configured to have a lower lip, two sides and an upper lip. The lower lip may be substantially linear, whereas the upper lip may be substantially curved.

The system for removing hair clippings from surgical patients includes the device of the present invention, a flexible and extendable hose attached to the device at one end, and a vacuum source, such as a vacuum pump, attached to the hose at its other end. An adaptor for attaching the hose to the device and an adaptor for attaching the hose to the vacuum pump may be used. A filter to collect the hair clippings may be placed inside the vacuum pump or in the vacuum line. When the vacuum pump is activated, shaving the patient may proceed. The hair clippings are drawn into the vacuum and removed so to prevent the possibility of contamination. The device, the hose, and the hair clipper may be disposable. The vacuum device may be reused.

FIGS. 1A, 1B, 1C, 1D, 1E, and 1F show an embodiment of the device of the present invention configured to fit the 3M™ surgical clipper showing the opening of the suction member 11, the suction member bottom side 12, the suction member top side 14, the hose attachment of the device 15, the first arm of the swiveling ball attaching member 16, the second arm of the swiveling ball attaching member 10, the suction member, the lower lip of the device opening 13, the first side of the device opening 17, the second side of the device opening 18, and the upper lip of the device opening 19.

FIGS. 2A, 2B, 2C, 2D, 2E, and 2F show an embodiment of the device of the present invention configured to fit the CardinalHealth® surgical clippers showing the opening of the suction member 21, the suction member bottom side 22, the suction member top side 24, the hose attachment of the device 25, the back side of the razor segment attaching member 26, the front side of the razor segment attaching member 27, the first flexible arm of the neck attaching member 20, the second flexible arm of the neck attaching member 28, the lower lip of the device opening 23, the first side of the device opening 29, the second side of the device opening 30, and the upper lip of the device opening 31.

FIGS. 3A, 3B, 3C, 3D, and 3E show an embodiment of the device of the present invention configured to fit the MediClip® surgical clippers showing the opening of the suction member 41, the suction member bottom side 42, the suction member top side 44, the hose attachment of the device 45, the back side of the razor segment attaching member 46, the front side of the razor attaching member 47, the first flexible arm of the neck attaching member 40, the second flexible arm of the neck attaching member 48, the lower lip of the device opening 43, the first side of the device opening 49, the second side of the device opening 50, and the upper lip of the device opening 51.

FIGS. 4A, 4B, 4C, 4D and 4E show the system for removing hair containing an embodiment of the device of the present invention configured to fit the CardinalHealth® surgical clippers showing the razor segment attaching member 68, the suction member 64, the neck attaching member 67, the hair clipper hand held piece 61, the razor segment 65, an on/off button 62, the hose 63 attached to the suction member 64, the hair clipper neck portion 66, the vacuum source 69, the filter 160, the hose attachment tip 162, the adaptor 164 between the suction member 64 and the hose 63, and the adaptor 60 between the vacuum source 69 and hose 63.

Figure 5A:
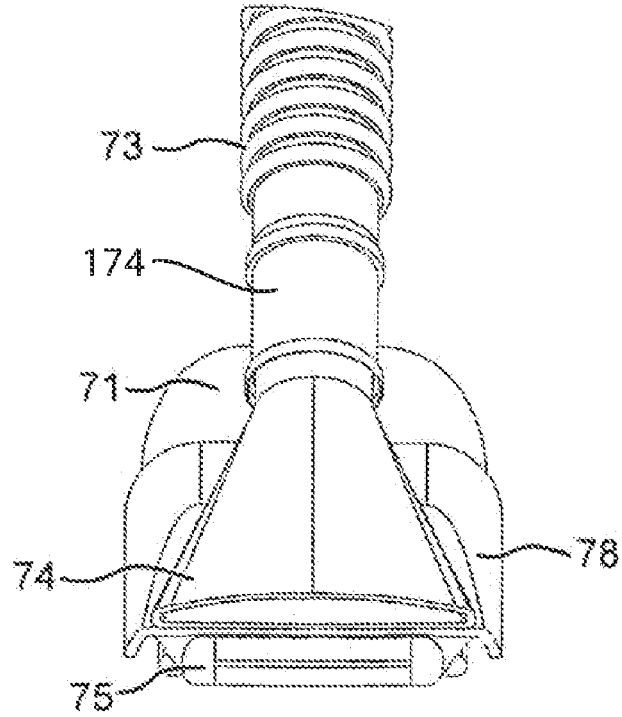
FIG. 5A is a front view of the system for removing hair containing the device according to the embodiment of FIG. 3A.
Figure 5B:
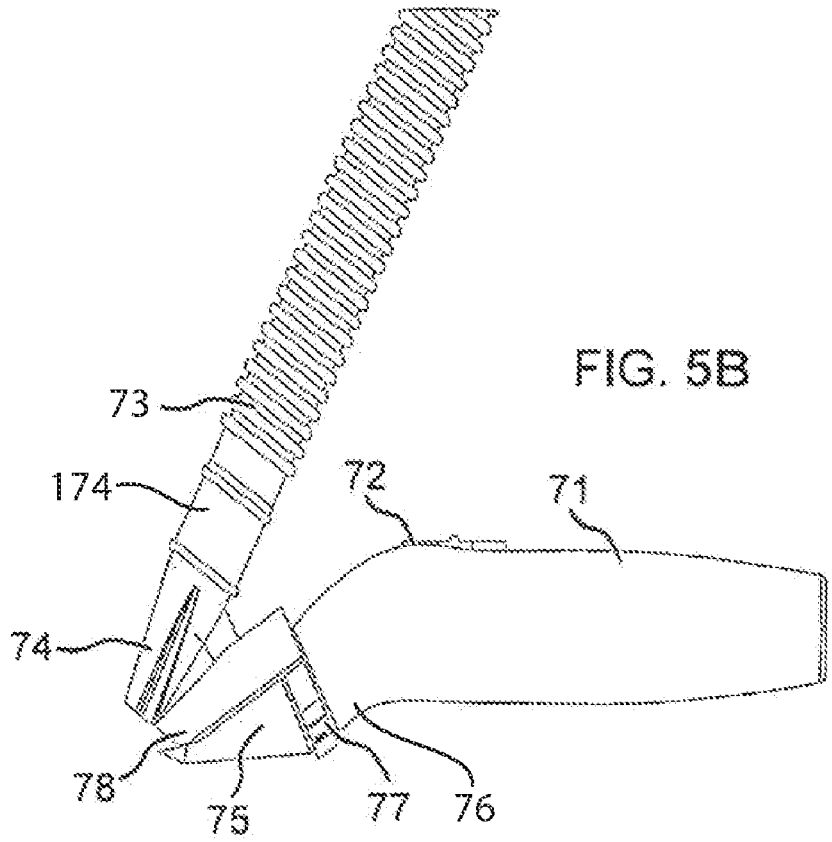
FIG. 5B is a side view of the system for removing hair containing the device according to the embodiment of FIG. 3A.
Figure 5C:
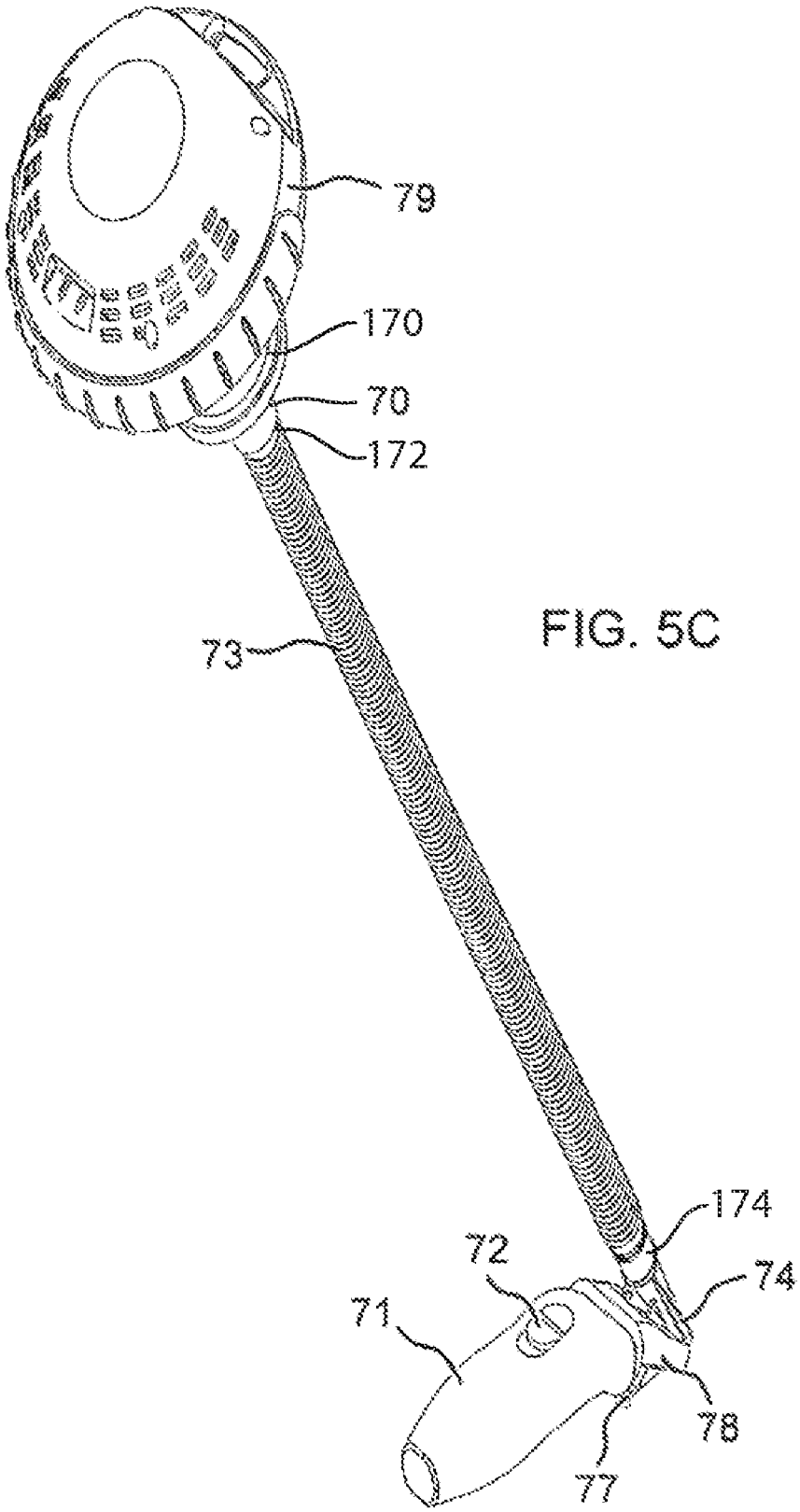
FIG. 5C is a top and rear perspective view of the system for removing hair containing the device according to the embodiment of FIG. 3A.
Figure 6A:
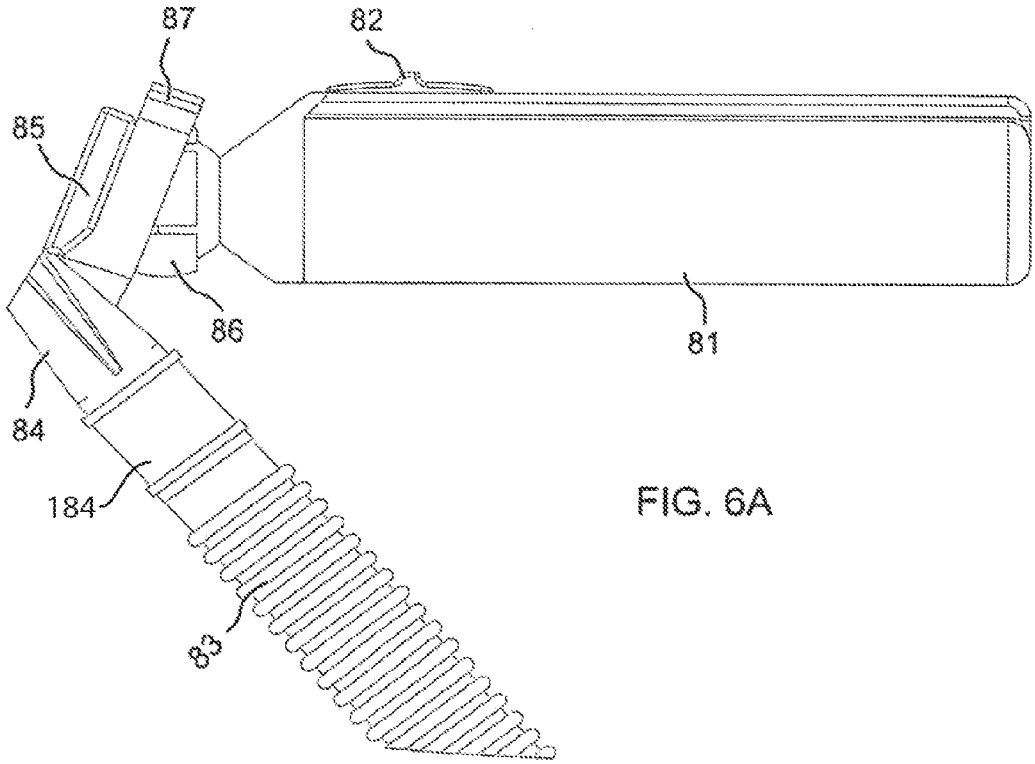
FIG. 6A is a side view of the system for removing hair containing the device according to the embodiment of FIG. 1A.
Figure 6B:
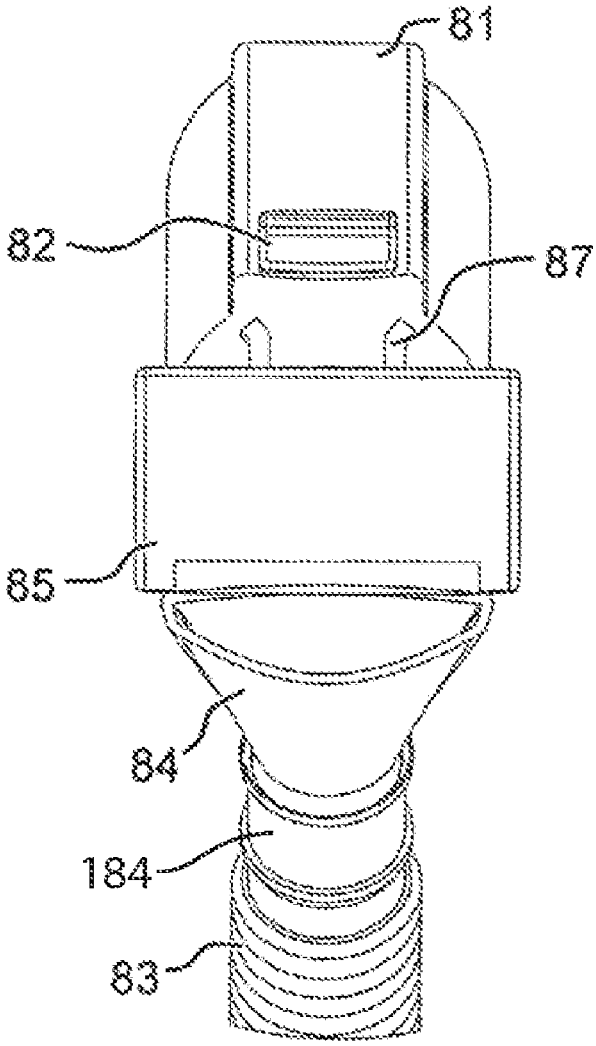
FIG. 6B is a front view of the system for removing hair containing the device according to the embodiment of FIG. 1A.
Figure 6C:
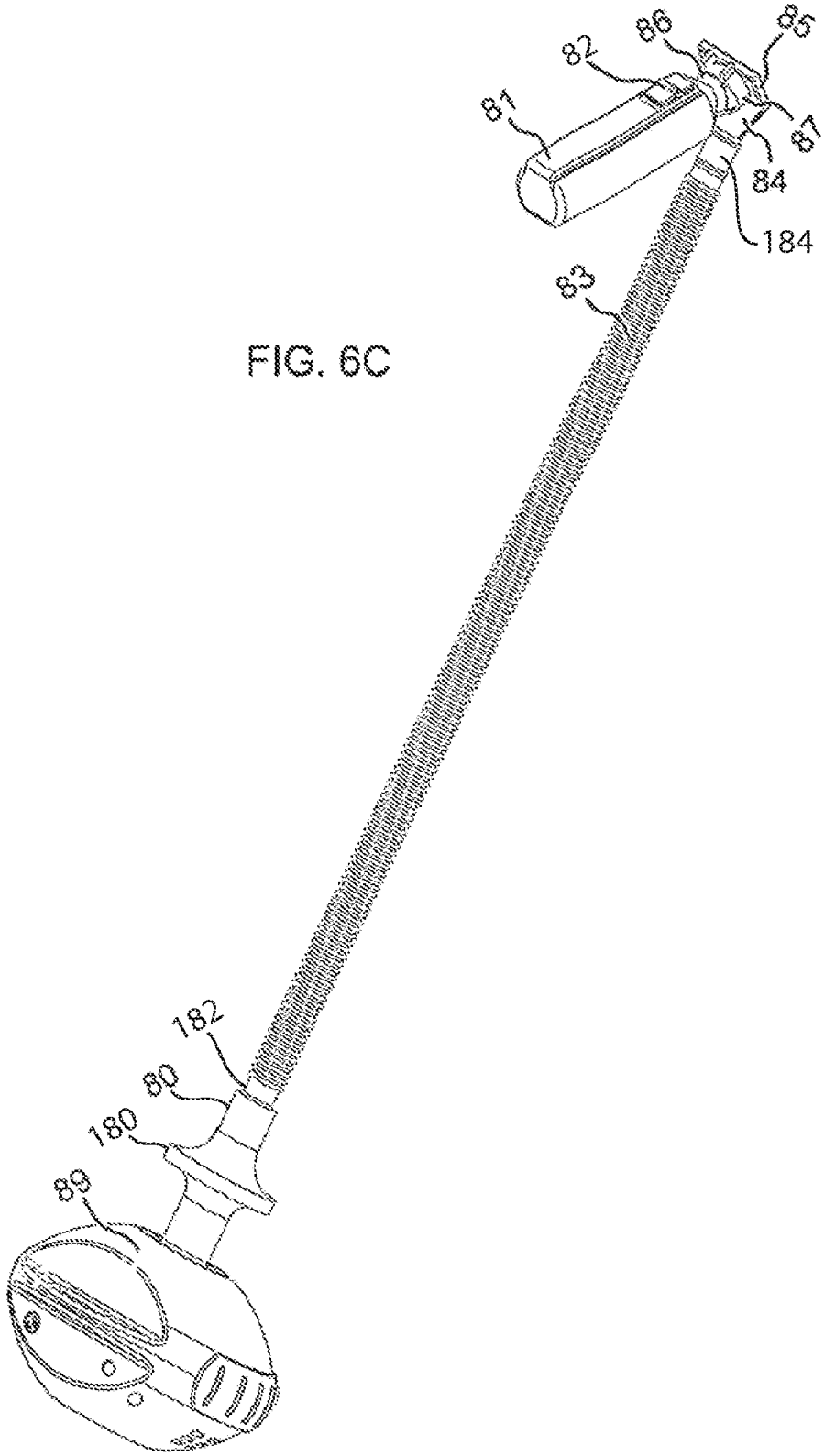
FIG. 6C is a bottom and rear perspective view of the system for removing hair containing the device according to the embodiment of FIG. 1A.
Figure 6D:
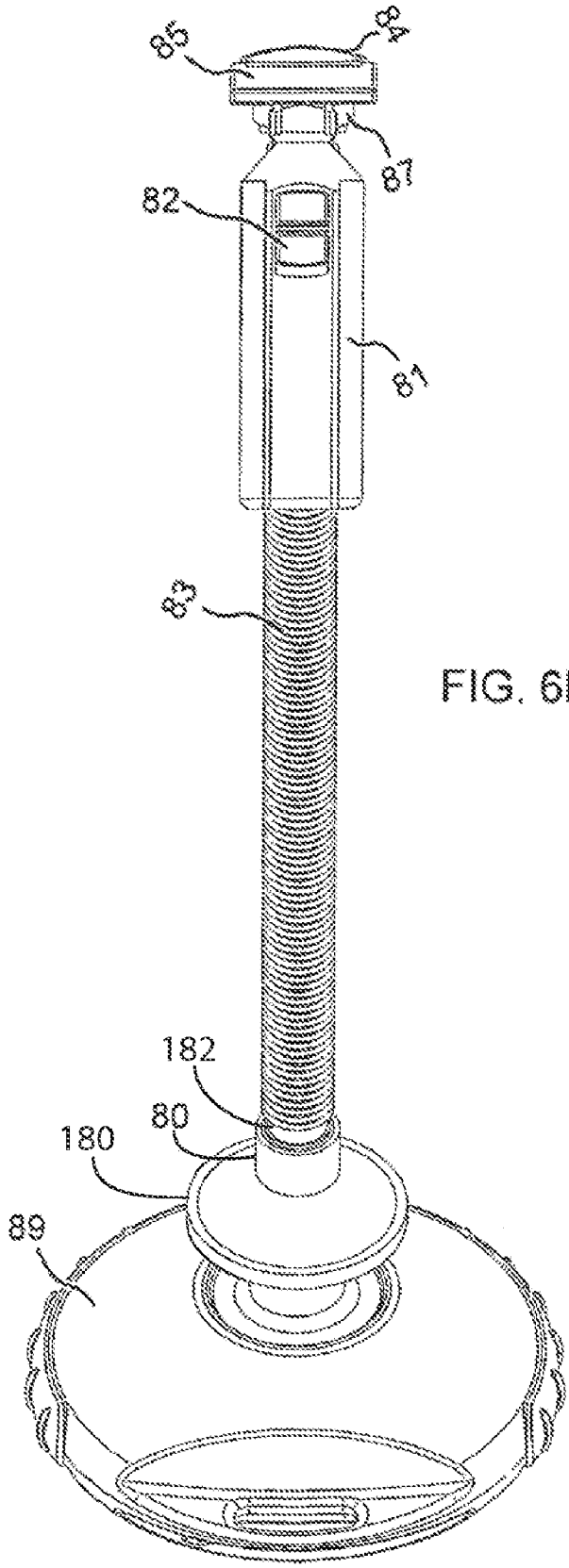
FIG. 6D is a bottom view of the system for removing hair containing the device according to the embodiment of FIG. 1A.

FIGS. 5A, 5B, and 5C show the system for removing hair containing an embodiment of the device of the present invention configured to fit the MediClip® surgical clippers showing the razor segment attaching member 78, the suction member 74, the neck attaching member 77, the hair clipper hand held piece 71, the razor segment 75, an on/off button 72, the hose 73 attached to the suction member 74, the hair clipper neck portion 76, the vacuum source 79, the filter 170, the hose attachment tip 172, the adaptor 174 between the suction member 74 and the hose 73, and the adaptor 70 between the vacuum source 79 and hose 73.

FIGS. 6A, 6B, 6C and 6D show the system for removing hair containing an embodiment of the device of the present invention configured to fit the 3M™ surgical clippers showing the swiveling ball attaching members 86, 87, the suction member 84, the hair clipper hand held piece 81, the razor segment 85 an on/off button 82, the hose 83 attached to the suction member 84, the vacuum source 89, the filter 180, the hose attachment tip 182, the adaptor 184 between the suction member 84 and the hose 83, and the adaptor 80 between the vacuum source 89 and hose 83.

We claim:

1. A system for removing clipped hair from surgical patients comprising:

a surgical hair clipper comprising a hand-held piece, a neck portion connected to the hand-held piece, and a razor segment connected to the neck portion;

a suction member having an opening, a top side and a bottom side;

a hose attachment member connected to said suction member;

a fastening member removably affixed onto the hair clipper, said fastening member being attached to the suction member and including a razor segment attaching portion and a neck attaching portion, said razor segment attaching portion being attached to said bottom side of the suction member and said neck attaching portion being attached to said razor segment attaching portion;

a hose having a first end and a second end, said first end of said hose being connected to the hose attachment member of said system; and a vacuum source comprising a hose attachment tip, said hose attachment tip of said vacuum source being connected to the second end of said hose.

2. The system of claim 1 further comprising an adaptor disposed between the first end of the hose and the hose attachment member of the system.

3. The system of claim 1 further comprising an adaptor disposed between the second end of the hose and the vacuum source.

4. The system of claim 1 further comprising a filter placed in the vacuum source for collecting vacuumed hair.

* * * * *